United States Patent [19]

Clark

[11] 3,951,097

[45] Apr. 20, 1976

[54] HYDRAULIC MOTOR OR PUMP

[76] Inventor: Wallace Clark, 1830 S. German Church Road, Indianapolis, Ind. 46239

[22] Filed: May 1, 1975

[21] Appl. No.: 573,535

[52] U.S. Cl. ..... 115/34 A; 114/.5 D; 114/151; 418/48

[51] Int. Cl.[2] ..... B63H 5/06

[58] Field of Search ..... 115/30, 28 R, 28 A, 115/34 A; 114/.5 D, 151; 418/48; 179/6

[56] References Cited

UNITED STATES PATENTS

| | | | |
|---|---|---|---|
| 2,483,370 | 9/1949 | Moineau | 418/48 |
| 3,056,374 | 10/1962 | Lindhart | 115/34 R |
| 3,599,595 | 8/1971 | James | 115/34 A |
| 3,603,407 | 9/1971 | Clark | 418/48 |

*Primary Examiner*—Duane A. Reger
*Assistant Examiner*—Jesus D. Sotelo

[57] ABSTRACT

A hydraulic motor or pump constituted by an inner and outer helical gear pair. The outer member of the pair is secured to one of the sections of at least one water swivel, and the inner member is connected to the other section by cooperating elements associated with at least one end of the inner member and the other section, which prevent relative rotation while permitting relative gyration of the inner member with respect to said outer member. The stationary section of the swivel serves as a mounting for the device. One or more gears, sprockets, pulleys or propellers may be secured to the rotating member of the pair, if it is the outer member which rotates, or to the rotating section of the swivel. By driving the rotating member, fluid may be pumped through the device, the direction of flow depending on the direction of rotation. By pumping fluid, by a separate pump, through the gear pair, the rotating member is caused to rotate in one direction or the other, depending on the direction of flow through the gear pair. With at least one propeller mounted on at least one rotating swivel section, or on the outer member if it is a rotating member, and driven by a separate pump, the device has utility for propulsion of a boat, barge, or semi-submersible well drilling platform, or for directional thrusting thereof, or with gears, sprockets or pulleys mounted on at least one rotating swivel section, it may simultaneously be used for driving auxiliary equipment. When the rotating member is driven by the use of gears, sprockets or pulleys, it may serve as a bilge pump.

23 Claims, 11 Drawing Figures

HYDRAULIC MOTOR OR PUMP

CROSS REFERENCE TO RELATED APPLICATION

This application is related to copending application Ser. No. 504,354 filed Sept. 9, 1974 entitled "Moineau Pump With Rotating Outer Member" which is a continuation in part of application Ser. No. 411,162 filed Oct. 30, 1973 entitled "Boat Propulsion Apparatus", now abandoned both in the name of the present inventor.

BRIEF SUMMARY OF THE INVENTION

As was pointed out in the aforementioned copending application, pumps comprising a helical gear pair have been known since their invention by R. J. L. Moineau and are disclosed in Moineau Pat. Nos. 1,892,217 dated Dec. 27, 1932 and 2,483,370 dated Dec. 27, 1949 and others. Reference may be had to these patents for a basic understanding of such pumps which are generally referred to as progressing cavity pumps.

Either member of the gear pair may rotate and it is a characteristic of such pumps that one of the two members must gyrate. Thus, the external member may be stationary while the internal member rotates and gyrates. The external member may be held against rotation and in such case when the internal member is rotated on its true axis, the external member will gyrate. Similarly, the external member may be rotated while the internal member is held against rotation. Then if the external member rotates on its true axis, the internal member must be permitted to gyrate. If the external member is permitted to gyrate, the internal member may be stationary.

Gear pairs as outlined above have been used as motors as taught, for example, in Clark U.S. Pat. No. 3,603,407.

In the aforesaid copending application, a pump is disclosed wherein the inner member is held against rotation but is permitted to gyrate, while the outer member rotates on its true axis. The outer member is fixed in a casing which extends beyond the gear pair and which constitutes a drive shaft for the pump. The direction in which fluid is pumped through the device is determined by the direction of rotation of the drive shaft and the pump may then be made uni-directional in either direction or it may be made reversible. In said application various bearing arrangements and sealing arrangements are disclosed for use depending upon the use to be made of the pump.

According to the present invention, the gear pair may be used as a pump in which the direction of flow through the pump is determined by the direction of rotation of the rotatable member. In the case of a motor, the direction in which fluid is pumped through the device determines the direction in which the rotatable member will rotate. A number of embodiments are disclosed herein and one of the basic elements of novelty is found in the use of so-called water swivels. A conventional well known water swivel comprises a fixed section and a rotating section. The rotating section rotates with respect to the fixed section on ball or roller bearings which serve not only as radial bearings but also as longitudinal thrust bearings. A water connection is established with the fixed section of the water swivel and seals are provided between the fixed and rotating sections, so that the rotating section and elements connected to it may rotate while water is passing through the water swivel without appreciable leakage.

Two basic embodiments are disclosed, one in which the outer member of the helical gear pair rotates while the inner member is held against rotation but is permitted to gyrate by means similar to those disclosed in the above mentioned copending application. In the other embodiment, the outer member is held stationary while the inner member rotates and gyrates. In the first embodiment, the outer element which rotates is secured to the rotating sections of water swivels at each end and the means to prevent rotation but to permit gyration of the inner member of the gear pair are provided in the stationary section of the water swivel.

In the second embodiment wherein the inner member of the pair rotates, the outer member of the pair is secured between the stationary sections of a pair of water swivels while the internal member is connected by means permitting gyration but preventing rotation with respect to the rotating sections of the water swivels.

There are also disclosed a number of applications of the hydraulic motor or pump as primary propulsion elements for boats or for bow or stern thrusters and for use with for example semi-submersible oil drilling rigs, both as propulsion units and as thrusters. Damping means to reduce vibration are also disclosed.

BRIEF DESCRIPTION OF THE SEVERAL VIEWS OF THE DRAWINGS

FIG. 3 is a somewhat diagrammatic fragmentary view of an installation of a unit according to FIG. 1 as a propulsion unit in a boat or the like.

FIG. 4 is a view similar to FIG. 3 showing the installation of a device according to FIG. 2 in a boat or the like.

DETAILED DESCRIPTION

It should be noted at the outset that the devices herein disclosed may have applications other than in the marine field. They may not have a great deal of value in such other fields because of the cost and because generally there is no need for the advantages provided by the device. These advantages make it particularly useful for marine applications. Among the advantages are that the device can operate remotely from the main engine when used as a pump and it can operate remotely from a pump when it is to be used as a motor. It is completely compatible with the marine environment and is perhaps particularly useful in such applications as primary propulsion systems or thrusters for semi-submersible well drilling platforms because of the fact that there is always access to powerful pumps provided on such platforms.

Marine thrusters are well known and are used to position and hold in position platforms or barges and ships at docks and in the process of docking. In any such application other than in small vessels and in the present state of the art, each thruster must have its own prime mover, which generally drives the thrusters through one or more right angle gear cases. Since on larger vessels several thrusters may be required, it would be of great advantage to have a large pump on the vessel which can direct the flow of fluid to the thruster best located to provide the proper thrust to move the vessel in the desired direction. As to any of the thrusters, the propeller can be reversed instantly by changing the direction of fluid flow by suitable valving, without stopping the engines, reversing them or changing gears, and without the risk of shock or damage, by virtue of the inherent hydraulic cushioning within the unit.

In the case of semi-submersible drilling platforms as known today, an electric motor is provided to drive each thruster and power is provided from a prime mover on board. This, however, requires underwater wiring and motors which must be carefully protected from water and particularly from salt water. The use of the device according to the present invention avoids underwater wiring with its attendant hazards and since the device may be made of elements which are commonly known to resist corrosion and commonly operate in water, the problems of corrosion are avoided.

Figure 1:
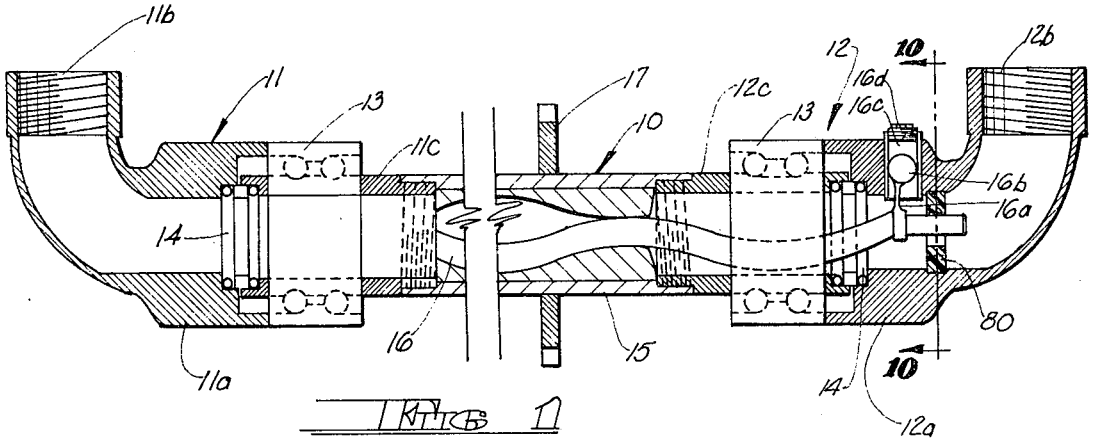
FIG. 1 is a longitudinal cross sectional view through a hydraulic motor or pump according to the present invention wherein the outer element of the gear pair is the rotating element.

Referring now to FIG. 1, a helical gear pair is generally indicated at 10 and it extends between two water swivels generally indicated at 11 and 12. Water swivels are well known and the ones illustrated here are exemplary only. Thus, each of the water swivels comprises a fixed or stationary section 11*a*, 12*a*, having fluid connections at 11b and 12b. Each of the water swivels has a rotating section indicated at 11*c* and 12*c* respectively, and as will be clear roller radial and thrust bearings are provided between the respective sections 11*a* and 11*c* and 12*a* and 12*c* as indicated at 13. Seals of a conventional nature are provided at 14 between the stationary and rotating sections of the two water swivels.

In the embodiment of FIG. 1, the outer member of the gear pair indicated at 15 is secured as by being threaded onto the rotating sections of the two water swivels 11*c* and 12*c*. The inner member of the gear pair indicated at 16 is prevented from rotation but permitted to gyrate by means of an arm 16*a* secured to the end of the member 16 and terminating in a ball 16*b* which may reciprocate and rock in a tube 16*c* disposed in the fixed section of the water swivel 12*a*. This particular construction is similar to that shown in the copending application above referred to.

A gear or sprocket or pulley 17 may be secured to the outer element 15 and by means of the member 17 the outer member 15 may be rotated and the device will then act as a pump and the direction of fluid flow through the pump will depend upon the direction of rotation of the member 17.

On the other hand, if fluid is pumped through the device of FIG. 1, the outer member 15 will be caused to rotate and this of course will cause the member 17 to rotate and by means of a take-off from the member 17 various auxiliary equipment may be driven. Similarly, a propeller may be mounted on the member 15 and the device can then act as a propulsion unit.

Figure 2:
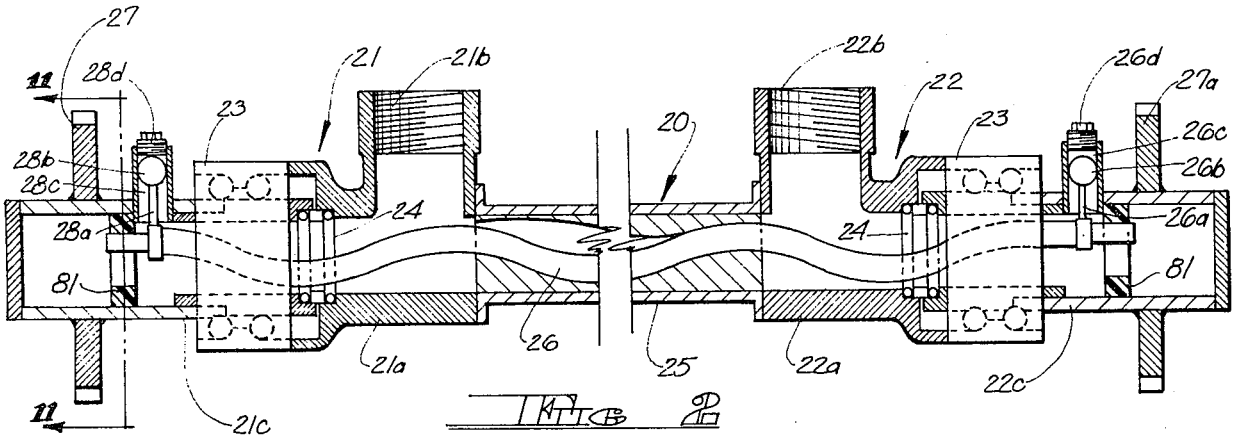
FIG. 2 is a view similar to FIG. 1 of an embodiment wherein the inner element is the rotating element.

The device of FIG. 2 differs from that of FIG. 1 in that the outer member is fixed. In this case, the water swivels are generally indicated at 21 and 22 and the gear pair is generally indicated at 20. The water swivel 21 has the fixed section 21*a* and the rotating section 21*c* and it has the water connection in the fixed section 21*a* as indicated at 21*b*. Similarly, the water switvel 22 has the water connection 22*b* in the fixed section 22*a* and it has the rotating section 22*c*. The rotating section of each swivel rotates with respect to the fixed section through the radial and thrust roller bearings 23. Seals 24 are provided between the rotating and fixed sections of each of the water swivels.

The stationary element of the gear pair is indicated at 25 and is connected to the fixed sections 21*a* and 22*a* of the two swivels. The rotating member of the gear pair indicated at 26 is fixed against rotation with respect to the rotating sections of the water swivels 21*c* and 22*c* by the arm, ball and tube arrangements 26*a*, 26*b*, 26*c* and 28*a*, 28*b* and 28*c* similar to those described at 16*a*, 16*b* and 16*c* in connection with FIG. 1. Gears, sprockets or pulleys or propellers may be secured to the sections 21*c* and 22*c* as indicated at 27 and 27*a*.

In this embodiment, the inner member of the gear pair 26 is prevented from rotation with respect to the rotating sections 21*c* and 22*c* of the water swivels but is permitted to gyrate with respect thereto. Thus, if fluid is pumped into the connection 21*b* or 22*b*, it causes the inner member 26 to rotate with respect to the fixed member 25 and by virtue of the connections above described to the sections 21*c* and 22*c* of the water swivel, these rotating sections are caused to rotate. The members 27 and 27*a* provide for power take-offs for auxiliary equipment or for the mounting of propellers or the like. The direction of rotation of the members 27, 27*a* is determined by whether the port 21*b* is the inlet and 22*b* the outlet, or vice versa.

If, on the other hand, power is supplied to either or both of the members 27, 27*a* to produce rotation of the inner member, then the gear pair acts as a pump and the direction of flow of fluid through the pump will be determined by the direction of rotation of the members 27 and 27*a*.

Figure 3:
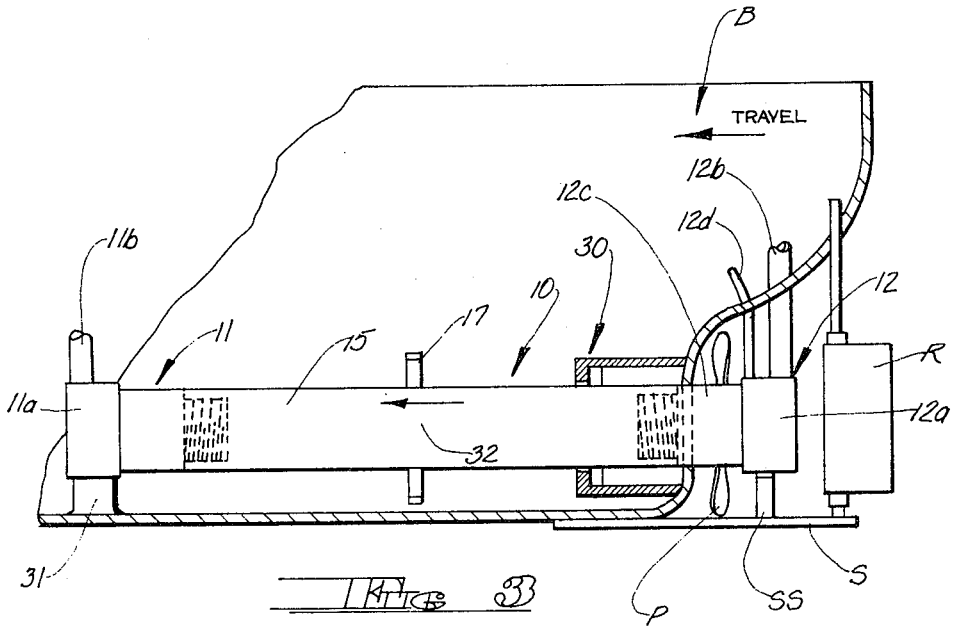

FIG. 3 shows somewhat diagrammatically a device according to FIG. 1 installed in a boat or the like indicated generally at B. The boat may have the usual skeg S and the usual rudder R and the usual shaft strut SS. A propeller P is mounted on the rotating member or the rotating section 12*c* of the water swivel 12. The rotating member may pass through the hull through a conventional hose type shaft log seal indicated generally at 30. The inboard end of the device may have a standard 31 secured to the stationary section 11*a* of the water swivel 11 and thereby provide a mounting means within the boat. The portion 12*a* of course is mounted by means of the shaft strut SS. If water is now pumped either into the connection 11*b* or 12*b*, the propeller and associated parts are caused to rotate and the direction of rotation depends upon the direction in which the fluid is pumped through the device. The member 17 may of course serve as a power take-off. A lubricant duct for the water swivel is indicated at 12*d*.

In an emergency, the device may serve as a bilge pump. Power may be applied by any type of prime mover to the element 17. By selection of the direction of rotation such that the connection 12*b* is used to suck up bilge water which is then discharged through the connection 11*b* the propeller still functions to maintain forward movement of the vessel, or astern if the connections and rotation are reversed.

In order to balance thrusts in the device, i.e. the thrust of the pumping gear pair and the thrust of the propeller, it is necessary to cause fluid to flow through the device, in this embodiment, in the desired direction of travel of the vessel, i.e., forward travel, as indicated by the arrow 32. It is also necessary that the hand of the propeller and the hand of the helical threads be the same for thrust balancing, and this is true of either embodiment—rotating inner member, or rotating outer member. It should be noted that in marine practice the hand of a propeller is determined as viewed from behind the vessel. If the propeller turns right hand (clockwise) when so viewed, and produces forward travel of the vessel, it is a right hand propeller.

Figure 4:
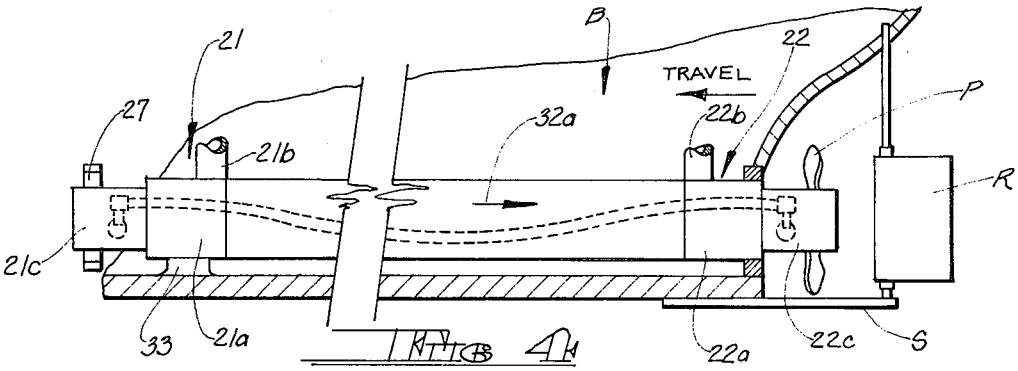

FIG. 4 is a view similar to FIG. 3 but showing a device similar to that of FIG. 2 installed as a propulsion unit in a boat or the like. In this embodiment, the fixed section 22*a* of the water swivel 22 may be solidly mounted in the hull and the rotating section 22*c* will then be disposed outboard and will carry the propeller P. The rudder R is mounted on the skeg S as in the embodiment of FIG. 3. The fixed portion of the swivel 21 indicated at 21*a* is mounted to the vessel by means of the pedestal 33. In this embodiment, in order to balance thrusts for forward travel of the vessel, the flow of fluid through the device must be in a direction opposite to the desired direction of travel of the vessel, as indicated by the arrow 32*a*. Again, the hand of the propeller and the hand of the helical threads must be the same, as described above in connection with FIG. 3. Similarly, the device may serve in an emergency as a bilge pump, by rotating the member 27 by any suitable prime mover. Thus, if the connection 21*b* is used to suck up bilge water, which is discharged through the connection 22*b*, the propeller functions to maintain forward movement of the vessel. If the connections and rotation are reversed the propeller will maintain astern movement of the vessel.

It should be noted that inspection plugs may be provided at 16*d*, 26*d* and 28*d* of FIGS. 1 and 2. While in FIG. 1 the rotation preventing device has been shown only at the right-hand end, such devices have been shown at both ends in FIG. 2. The use of these devices at one end only is sufficient to make the device work properly, although in some instances it may be desirable to have such devices at both ends. In the case of the embodiments of FIGS. 3 and 4, it is desirable to have these devices only at the inboard end so that easy access may be had to the inspection plugs for maintenance and service, but again, the devices may be provided at both ends if desired, as shown in FIG. 4.

Figure 5:
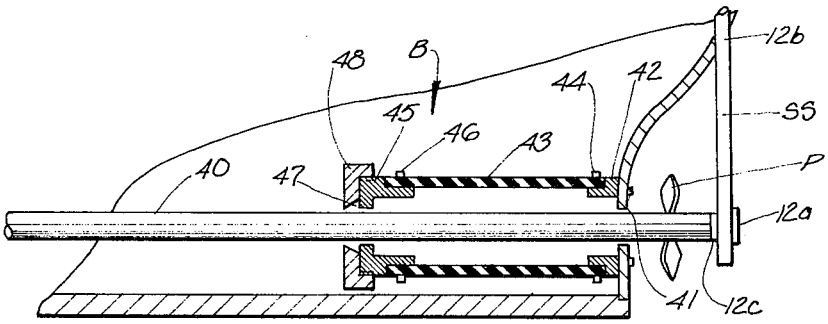
FIGS. 5 and 6 are fragmentary diagrammatic cross sectional views showing two embodiments for passing the rotating shaft through the hull of a boat.
Figure 6:
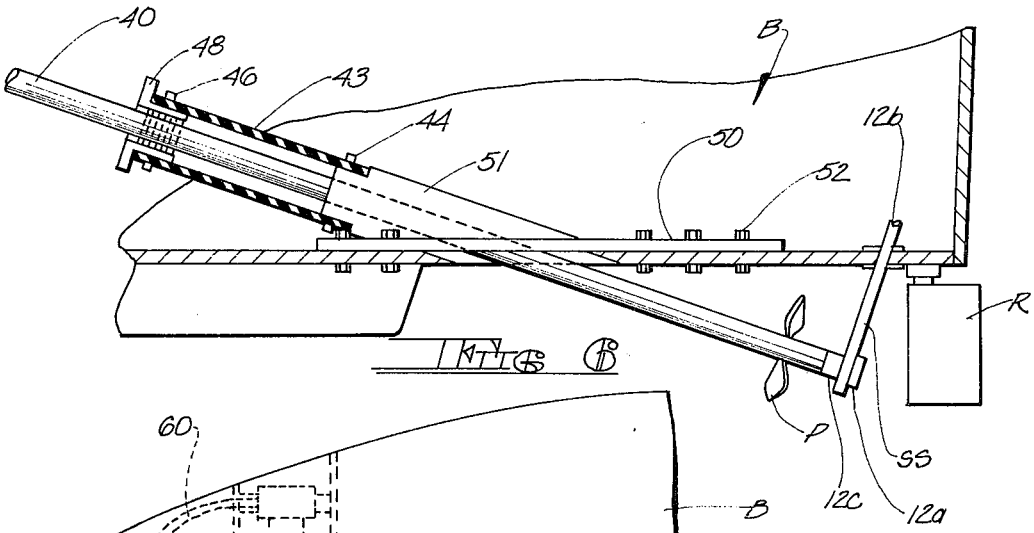

FIGS. 5 and 6 illustrate two different ways in which the rotating portion of the device may pass through the hull. In both of these Figures, 40 indicates the rotating section of the device to which the propeller is attached. This may be either the member 15, 11*c*, 12*c* of FIG. 1 or 21*c*, 22*c* of FIG. 2. FIG. 5 indicates a conventional rubber hose type shaft log wherein the shaft 40 passes through the hull without contact therewith and the opening through which the shaft passes and indicated at 41 is surrounded by a flanged ring 42 to which a piece of rubber hose 43 is secured by means of a hose clamp 44. At its other end, the hose 44 is secured to a packing gland 45 by means of a hose clamp 46 and the packing material in the area 47 is compressed by means of the packing nut 48.

In the embodiment of FIG. 6, the shaft 40 passes through the hull at an angle. A metal plate 50 integral with a tube 51 angularly related is bolted with a gasket to the bottom of the boat by means of bolts 52. A hose 43 is secured to the end of the member 51 by the hose clamp 44, and at the other end there may be provided a well known arrangement comprising a series of washers, alternately of metal and packing material, held in place in the member 48 by a very short coil spring or spring washer, keeping the series of washers under light compression. Such a seal is self-adjusting, requires no attention, and avoids shaft scoring which can result from over-tightening a nut in an arrangement such as that of FIG. 5.

Figure 7:
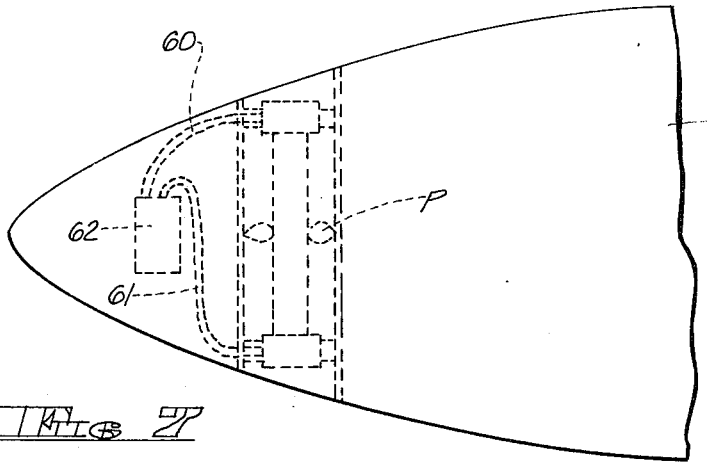
FIG. 7 shows the device according to FIG. 1 in position as a bow thruster in a boat.

FIG. 7 is a fragmentary view indicating how the device of FIG. 1 may be mounted to provide a bow thruster. A transverse tube is provided through the boat and indicated at T and within the tube T the device of FIG. 1 is mounted and suitably connected as indicated by piping 60, 61 to a pump 62. By suitable valving which is well understood by those skilled in the art, and therefore need not be described here, the direction of rotation of the propeller P may be changed to provide for thrust in the desired direction.

Figure 8:
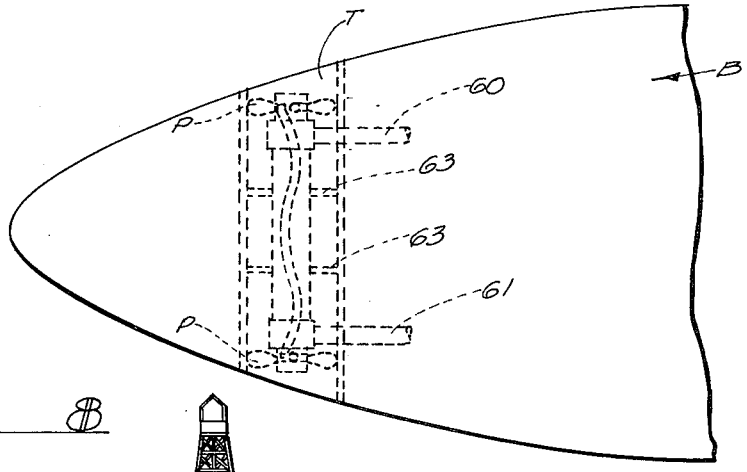
FIG. 8 is a view similar to FIG. 7 showing a device according to FIG. 2 as a bow thruster in a boat.

FIG. 8 is a similar view showing a device according to FIG. 2 mounted in a tube T as a bow thruster. In this embodiment, the device may have two propellers, for example, as indicated at P, and it is mounted by means of suitable brackets 63 and is provided with the hose connection 60 and 61.

Figure 9:
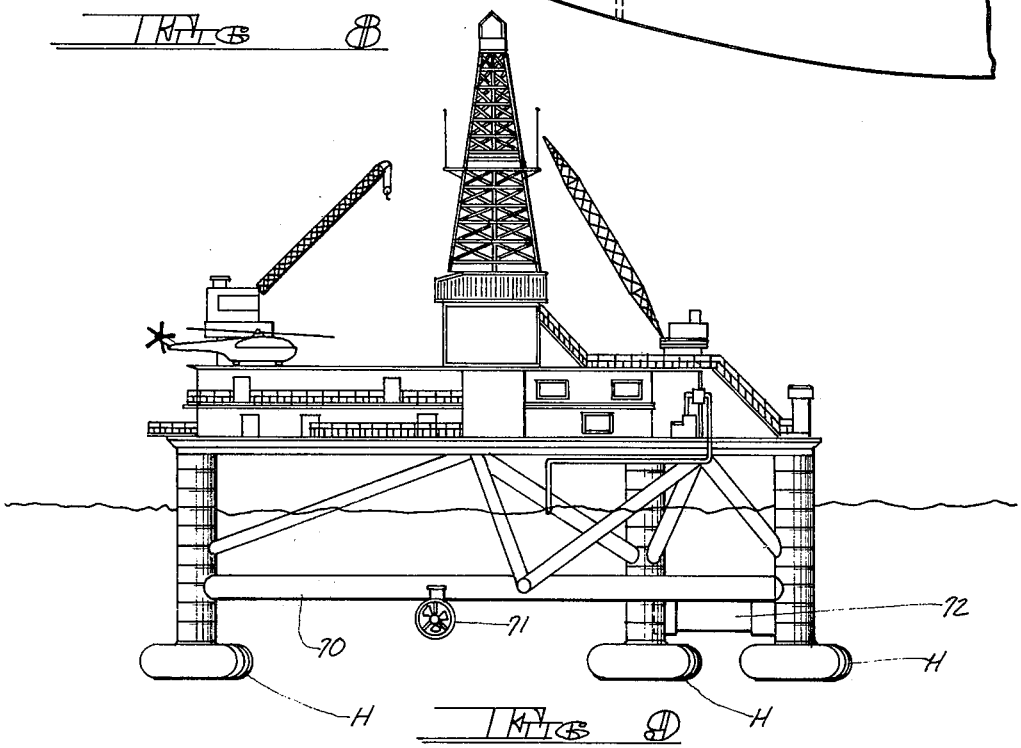
FIG. 9 is a somewhat diagrammatic view of a semi-submersible oil drilling rig showing the application of devices according to the invention as propulsion units and/or thrusters.

FIG. 9 illustrates the use of devices according to either FIGS. 1 or 2 as primary propulsion units or as thrusters in connection with semi-submersible oil drilling rigs. FIG. 9 generally shows such a rig having the hulls H and having various structural elements as indicated at 70. One thruster is indicated at 71 and another disposed at right angles thereto is indicated at 72. In the embodiment of FIG. 9, the thrusters may be mounted outboard on a structural member, such as the member 70, or they might be in a pontoon or nacelle. There is a great advantage in having the thrusters supported by struts at both ends but in the open from a structural member, so that there is practically no obstruction to propeller water thrust in either direction. This advantage cannot be achieved with electric motors because their diameters are such as to prohibit the achievement of this advantage.

Figure 10:
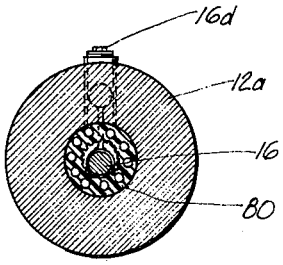
FIG. 10 is a cross sectional view taken on the line 10—10 of FIG. 1 showing vibration damping means.
Figure 11:
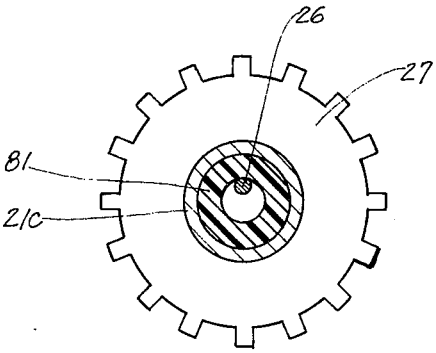
FIG. 11 is a cross sectional view taken on the line 11—11 of FIG. 2 showing vibration damping means.

Thus far, reference has not been made to the parts indicated at 80 in FIG. 1 and 81 in FIG. 2. These parts serve the purpose of dampening vibrations and while they are not necessary to the functioning of the hydraulic motor or pump, they are desirable from the standpoint of reducing vibration. These parts are much like marine bearings used in water at the exit of the drive shaft for the propeller on ships. In the embodiment of FIGS. 1 and 10 where the inner member is stationary, the member 16 simply gyrates within the member 80. The member 80 does not rotate. In the embodiment of FIGS. 2 and 11, the member 81 is mounted in the rotating section 21*c* of the water swivel and therefore it does rotate and the member 26 likewise rotates. The diameter of the opening in the members 80 and 81 is equal to the diameter of the respective inner members 16 or 26 plus twice the eccentricity of the inner member (i.e., the total amount of gyration across a diameter). In both embodiments, there is only very minor friction resulting from the oscillations of the inner member as it gyrates and this is a line friction, subtracting or adding to the line friction due to difference in the relative surface speeds of the areas of the members in contact. It will be understood that the members 80 or 81 may be provided in both swivels if desired or in only one end of the device if that all that is needed.

It may be pointed out that with the inner member stationary as in the embodiment of FIG. 1, the ball and tube arrangement need be used on one end only. A similar arrangement on the other end would serve no particular purpose and would make alignment much more difficult.

It should also be noted that the eccentricity which must be present in devices using the Moineau principle, creates forces which normally pass outside the area of power generation by the rotor and stator. These eccentric forces, which contribute to power loss and undue wear, are almost totally eliminated by the ball and tube concept for handling the eccentricity problem, as disclosed herein, and in said copending application.

It will be understood that numerous modifications may be made without departing from the spirit of the invention, and therefore no limitation not expressly set forth in the claims is intended and no such limitation should be implied.

The embodiments of the invention in which an exclusive property or privilege is claimed are defined as follows:

1. A hydraulic motor or pump device comprising a helical gear pair constituted by an inner member having an external helical thread, and a cooperating outer member having one more internal helical thread than the number of external helical threads on said inner member, the outer member being secured to one of the sections of a water swivel having a rotating and a stationary section, the stationary section constituting a mounting means for said device; and means associated with an end of said inner member and with the other of said sections to prevent rotation while permitting gyration of said inner member relative to said outer member; whereby when rotation is imparted to that member connected to the rotating section of said water swivel, the helical gear pair acts as a pump, the direction of flow through said device depending on the direction of said rotation; and when fluid is pumped through said device by means of an external pump, that member connected to the rotating section of said swivel is caused to rotate and constitute a motor, the direction of rotation of said motor depending on the direction in which fluid is pumped through said device.

2. The device of claim 1, wherein the means for preventing relative rotation while permitting relative gyration of said inner member comprise an arm extending normal to the axis of said inner member at an end thereof, and carrying a cross-head and a radially arranged slide within said other section, said cross-head being disposed in said slide and being capable of reciprocatory and oscillatory motion therein.

3. The device of claim 2, wherein said cross-head is a ball, and said slide is a tube having an inside diameter snugly but slidingly accommodating said ball.

4. The device of claim 1 having a marine propeller mounted on the rotating one of said members.

5. The device of claim 1 having power transmission means mounted on the rotating one of said members.

6. The device of claim 1, wherein said outer member is secured to the stationary section of said water swivel, and said inner member is connected by said relative rotation preventing means to the rotating section of said swivel.

7. The device of claim 6 having a marine propeller mounted on the rotating section of said swivel.

8. The device of claim 6 having power transmission means mounted on the rotating section of said swivel.

9. The device of claim 6 mounted in a vessel with the stationary section of said swivel mounted inboard on the transom of said vessel, and with the rotating section disposed outboard of said transom and having a propeller mounted thereon.

10. The device of claim 9, wherein the hand of said helical threads is the same as the hand of the propeller, and fluid is pumped through said device opposite to the desired direction of travel of the vessel, thereby producing a balance of thrusts of the propeller and rotating member in either forward or astern direction.

11. In a vessel having a tunnel transverse to its longitudinal axis and below the water line thereof, a device according to claim 9 mounted in said tunnel between two water swivels, the outer member being secured at its ends to the stationary sections of said swivels, and the inner member being connected at its ends to the rotating section of said swivels by means of said relative rotation preventing means, and said rotating sections each having a propeller mounted thereon.

12. The device of claim 1, wherein said outer member is secured to the rotating section of said water swivel, and said inner member is connected by said relative rotation preventing means to the stationary section of said swivel.

13. The device of claim 12 having a marine propeller mounted on said rotating member or section.

14. The device of claim 12 having power transmission means mounted on said rotating member or section.

15. The device of claim 12, wherein two water swivels are provided, and said outer member is secured at each end to the rotating section of one of said swivels.

16. The device of claim 15 mounted in a vessel, a propeller mounted on said outer member adjacent one of said water swivels, said one water swivel and propeller being disposed outboard of said vessel with said swivel mounted on a strut, the other swivel being disposed inboard of said vessel, and said outer member passing through said hull by means of a hose-sealed type shaft log.

17. The device of claim 16, wherein the hand of said helical threads is the same as the hand of said propeller, and fluid is pumped through said device in the desired direction of travel of the vessel, producing a balance of thrusts of the propeller and rotating member in forward or astern direction.

18. The device of claim 18, wherein the swivel having the relative rotation preventing means is disposed inboard of said vessel.

19. In a vessel having a tunnel transverse to its longitudinal axis and below the water line thereof, a device according to claim 15 mounted in said tunnel and having a propeller mounted substantially centrally of said outer member, for use as a bow thruster.

20. A device according to claim 1 mounted on the understructure of a semi-submersible well drilling platform to serve as a propulsion unit for moving said platform, or as a thruster to assist in maintaining the position of said platform.

21. The device of claim 1, wherein a rubber ring, having a plurality of grooves parallel to its axis on its inner surface, is secured to the inner wall of said other of said sections of said swivel, and surrounding a portion of said inner member, the inside diameter of said rubber ring being equal to the diameter of said inner member plus the amount of diametric gyration of said inner member.

22. The device of claim 21, wherein said outer member rotates, and said rubber ring is secured to the stationary section of said water swivel.

23. The device of claim 21, wherein said inner member rotates, and said rubber ring is secured to the rotating section of said water swivel.

* * * * *